US005348071A

United States Patent [19]

Cook

[11] Patent Number: 5,348,071

[45] Date of Patent: * Sep. 20, 1994

[54] TOP FILL CASTING

[75] Inventor: Arnold J. Cook, Pittsburgh, Pa.

[73] Assignee: PCC Composites, Inc., Pittsburgh, Pa.

[ * ] Notice: The portion of the term of this patent subsequent to May 12, 2009 has been disclaimed.

[21] Appl. No.: 77,886

[22] Filed: Jun. 15, 1993

Related U.S. Application Data

[63] Continuation of Ser. No. 880,228, May 8, 1992, abandoned, which is a continuation-in-part of Ser. No. 596,062, Oct. 11, 1990, Pat. No. 5,111,870.

[51] Int. Cl.[5] ..... B22D 18/00; B22D 19/14

[52] U.S. Cl. ..... 164/61; 164/66.1; 164/97; 164/119; 164/122.1; 164/124; 164/125; 164/127; 164/259; 164/284; 164/306; 164/337

[58] Field of Search ..... 164/61, 66.1, 97, 119, 164/122, 122.1, 124, 125, 127, 259, 284, 306, 337

[56] References Cited

U.S. PATENT DOCUMENTS

| | | | |
|---|---|---|---|
| 3,547,180 | 12/1970 | Cochran et al. | 164/61 |
| 3,712,364 | 1/1973 | Daniel et al. | 164/63 X |
| 4,597,431 | 7/1986 | Hobo et al. | 164/258 X |
| 4,762,165 | 8/1988 | Ogino et al. | 164/61 X |
| 4,770,704 | 9/1988 | Gibson et al. | 164/122.1 X |
| 4,789,140 | 12/1988 | Lirones | 164/337 X |
| 4,832,105 | 5/1989 | Nagan et al. | 164/61 |
| 4,919,191 | 4/1990 | Brodersen | 164/61 X |
| 5,111,870 | 5/1992 | Cook | 164/61 |

OTHER PUBLICATIONS

"Fabrication of Cast Particulate Reinforced Metals via Pressure Infiltration", Klier, E. M., submitted to the Dept. of Materials and Science, May 1988.

"Intrinsic Toughness of Interfaces Between SiC Coatings and Substrates of Si or C Fibre", Argon, A. S., Gupta, V., vol. 24, 1989, pp. 1207-1218.

"Interfaces with Controlled Toughness as Mechanical Fuses to Isolate Fibres From Damage", Gupta, V., Argon, A. S., Cornie, J. A., Journal of Materials Science, vol. 24, 1989, pp. 2031-2040.

"Columnar Dendritic Solidification in a Metal-Matrix Composite", Mortensen, A., Cornie, J. A., Flemings, M. C., Metallurgical Transactions A, vol. 19A, 1988, pp. 709-721.

"Infiltration of Fibrous Preforms by a Pure Metal: Part I. Theory", Mortensen, A., Masur, L. J., Cornie, J. A., Flemings, M. C., Metallurgical Transactions A, vol. 20A, Nov. 1989, pp. 2535-2547.

(List continued on next page.)

*Primary Examiner*—J. Reed Batten, Jr.
*Attorney, Agent, or Firm*—Ansel M. Schwartz

[57] ABSTRACT

The apparatus for casting comprises a pressure vessel and a device for pressurizing the vessel. The pressurizing device is in fluidic connection with the vessel. The apparatus is also comprised of a chamber disposed in the pressure vessel within which material is melted. There is a mold adapted to contain a preform disposed in the vessel and in fluidic connection with the chamber by a passage such that melted material in the chamber can be forced down into the mold through the passage as the pressurizing device pressurizes the vessel. A heating device is disposed in the vessel. There is also a device for directionally solidifying the material in the mold. Additionally, there is a method comprising the steps of loading the pressure vessel by disposing a material within the chamber whereby the material is in fluidic connection with the mold adapted to contain a preform through the passage. The passage has a filter disposed therein. Next, there is the step of melting the material in the chamber whereby the melted material fluidically seals the passage thereby isolating the interior of the mold from the interior of the vessel. The filter prevents melted material from entering the interior of the mold.

10 Claims, 7 Drawing Sheets

OTHER PUBLICATIONS

"Liquid Infiltration of Metal Matrix Composites" Savrun, E., Grenni, A ., Keramont Corporation, U.S.A., Keramont Italia, S.p.A., ATA Events, Italy, Jun. 26–28, 1989.

"Processing of Metal and Ceramic Matrix Composites", Cornie, J. A., Chiang, Y. M., Uhlman, D., Mortensen, A., Collins, J. M., Bulletin of the American Society, vol. 65, Feb. 1986, pp. 293–304.

"On the Infiltration of Metal Matrix Composites", Mortensen, A., Cornie, J. A., Metallurgical Transacations A, Jun. 1987, pp. 1160–1163.

"The Solidification Process During Pressure Casting SiC and $Al_2O_3$ Reinforced A1–4.5% Cu Metal Matrix Composites", Cornie, J. A., Mortensen, A., Gungor, M. N., Flemings, M. C., Proceedings of the Fifth International Conference on Composite Materials, San Diego, Calif. 1985, pp. 809–823.

"Analysis of a Squeeze–Infiltration Process For Fabrication of Metal Matrix Compsites", Clyne, T. W., Bader, M. G., Proceeding of the Fifth International Conference on Metal Matrix Composites, 1985, pp. 755–771.

"The Squeeze Infiltration Process for Fabrication of Metal Matrix Composites" Clyne, T. W., Mason, J. F., Metallurgical Transactions A, vol. 18A, Aug. 1987, pp. 1519–1530.

"Silicon Carbide Reinforced Aluminum–A Formable Composite", Divecha, A. P., Fishman, S. G., Karmarkar, S. D., Journal of Metals, vol. 33, Sep. 1981.

"The Production–Scale Squeeze Casting of Devitroceramic Fiber Reinforced Aluminum and its Mechanical Properties", Fukunaga, H., Komatsu, S., Kanoh, Y., Bulletin of the JSME, vol. 26, No. 220, Oct. 1983, pp. 1814–1819.

TOP FILL CASTING

This is a continuation application of U.S. patent application Ser. No. 07/880,228 filed May 8, 1992, now abandoned, which is a continuation-in-part of U.S. patent application Ser. No. 07/596,062 filed Oct. 11, 1990, which is now U.S. Pat. No. 5,111,870, issued May 12, 1992.

FIELD OF THE INVENTION

The present invention is related to casting. More specifically, the present invention is related to an apparatus and method for pressure casting whereby the material is forced into a mold from the top.

BACKGROUND OF THE INVENTION

Composite products comprising a metal matrix and a reinforcing phase such as ceramic particulates, show great promise for a variety of applications because they combine the stiffness and wear resistance of the reinforcing phase with the ductility and toughness of the metal matrix.

Various metallurgical processes have been described for the fabrication of aluminum matrix composites. These methods are, for instance, based on powder metallurgy techniques and liquid metal infiltration techniques which make use of pressure casting, vacuum casting, stirring and wetting agents. Pressure Infiltration Casting as described in U.S. Pat. No. 5,111,871 by Arnold J. Cook and entitled "Method of Vacuum Casting" describes pressure casting apparatus whereby the mold, metal and heating means are contained within a pressure vessel. The described method for casting essentially comprises the steps of evacuating the pressure vessel while melting the metal within a crucible. The mold, which has a snorkel, is disposed on top of the crucible. The molten metal is fluidically connected to the mold by disposing the snorkel in the crucible of molten metal, thereby isolating the inside of the mold from the interior of pressure vessel. Inert pressurized gas is then used to force the molten metal into the mold. This method necessitates separate steps for melting the metal and fluidically isolating the inside of the mold from the interior of the pressure vessel. Further, a mechanical apparatus, such as a crucible lifter, is needed to connect the snorkel and melted metal before pressurization.

An improvement of this process and apparatus is described in the present invention whereby solid metal is disposed in a chamber on top of the mold. A passage fluidically connects this chamber to the inside of the mold. As the metal is melted, the molten metal covers the passage thereby fluidically isolating the inside of the mold from the interior of the vessel in one step.

SUMMARY OF THE INVENTION

An apparatus for casting comprises a pressure vessel and means for pressurizing the vessel. The pressurizing means is in fluidic connection with the vessel. The apparatus is also comprised of a chamber disposed in the pressure vessel within which material is melted. There is a mold adapted to contain a preform disposed in the vessel and in fluidic connection with the chamber by a passage such that melted material in the chamber can be forced down into the mold through the passage as the pressurizing means pressurizes the vessel. A heating device is disposed in the vessel. There is also means for directionally solidifying the material in the mold.

Additionally, there is a method comprising the steps of loading the pressure vessel by disposing the material within the chamber whereby the material is in fluidic connection with the mold adapted to contain a preform through the passage. The passage has a filter disposed therein. Next, there is the step of melting the material in the chamber whereby the melted material fluidically seals the passage thereby isolating the interior of the mold from the interior of the vessel. The filter prevents melted material from entering the interior of the mold. Next, there is the step of pressurizing the vessel such that the melted material is forced past said filter and into the interior of the mold and into the preform. Then, there is the step of directionally solidifying the material in the mold.

In an alternative embodiment, there is an apparatus for casting. The apparatus for casting comprises a pressure vessel comprising a melt section and a mold section separated by a surface. The melt section is disposed in the upper portion of the pressure vessel. The melt section comprises a crucible within which material is stored and melted, a first hole disposed on the crucible's bottom surface and a second hole disposed under said first hole in the surface. There is also a plug lift system comprising a plug and a plug lifter whereby the plug lifter raises and lowers the plug into and out of the first hole such that when the plug is lowered into the first hole, the melted material cannot flow out of the crucible. The mold section is disposed in the lower portion of the pressure vessel. The mold section is comprised of a chamber for holding the melted material. The mold section is also comprised of means for pressurizing the vessel. The pressurizing means is in fluidic connection with the vessel. There is a mold having a passage fluidically connecting said chamber to the interior of the mold. The passage includes a filter such that a melted material is prevented from entering the interior of the mold prior to pressurization. Additionally, there is means for heating material in the crucible such that material is melted in the crucible and stays melted as it flows downward into the chamber of the mold section as the plug lifter lifts the plug away from the hole of the crucible. There is also means for directionally solidifying the material.

BRIEF DESCRIPTION OF THE DRAWINGS

In the accompanying drawings, the preferred embodiment of the invention and preferred methods of practicing the invention are illustrated in which:

FIGS. 2A–2G are cross-sectional schematic views showing an apparatus and a method for top fill casting when a substantial temperature differential between the mold and material is desired.

DESCRIPTION OF THE PREFERRED EMBODIMENT

Figure 1A:
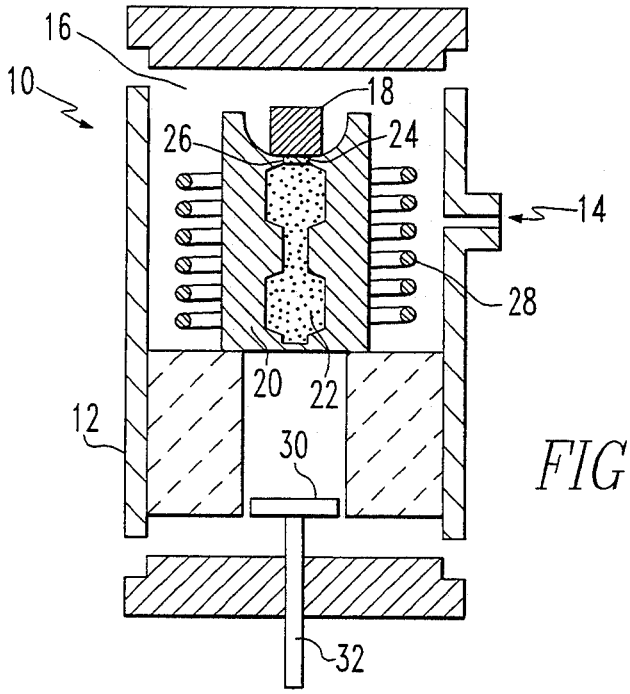
FIGS. 1A–1F are cross-sectional schematic views showing the top fill casting method.

Referring now to the drawings wherein like reference numerals refer to similar or identical parts throughout the several views, and more specifically to FIG. 1A thereof, there is shown a cross-sectional schematic view of an apparatus 10 for casting. The apparatus 10 comprises a pressure vessel 12 and means for pressurizing and preferably evacuating the vessel. The vessel 12 is preferably made of steel. The evacuating and pressurizing means are in fluidic connection with the vessel 12 through port 14. The apparatus 10 is also comprised of a chamber 16 disposed in the pressure vessel 12 within which material 18, such as aluminum, is melted. There is a mold 20 preferably adapted to contain a preform 22 disposed in the pressure vessel 12 within which a preform 22 is held although the invention is not in any way limited to the presence of a preform 22 within the mold 20. A passage 24 fluidically connects the chamber 16 to the interior of mold 20. Preferably, a filter 26, such as a porous ceramic insert, is disposed within the passage 24 such that the melted material 18 is prevented from entering the interior of mold 20 while the vessel 12 is unpressurized. The mold 20 is preferably made of 304 stainless steel, however, other materials can also be used such as investment material. The preform 22 is preferably made of silicon carbide fibers.

Since the mold 20 is in fluidic connection with the melted material 18, melted material 18 in the chamber 16 can be forced down into the mold 20 as the pressurizing means pressurizes the vessel 12. Typical pressures for use with a preform of silicon carbide fibers in the mold 20, and melted aluminum are 1000 PSI-2000 PSI and preferably 1300 PSI-1500 PSI. The pressure required is related to the volume fraction of fibers. In general, the more fibers per given unit of volume, the greater pressure is required to force the melted material between the fibers.

The apparatus is also comprised of means for heating material 18 in the chamber 16 and mold 20 such that material 18 is melted in the chamber 16 and stays melted as it forms a liquid seal over the passage 24 and when it is forced into the mold 20 while the pressurizing means pressurizes the vessel 12. The heating means is preferably disposed in the vessel 12 and preferably includes a mold furnace 28. The heating means should provide enough heat to maintain the material in a melted state. For instance, with aluminum, the temperature should be over 600° C. and preferably between 650° C. and 700° C. The heating means preferably includes a furnace 28 for heating the mold 20 and material 18 and is preferably positioned about the mold 20 to provide essentially uniform heating to the mold 20, preform 22 and material 18, respectively. The apparatus is also comprised of means for directionally solidifying the material in the mold.

Figure 1B:
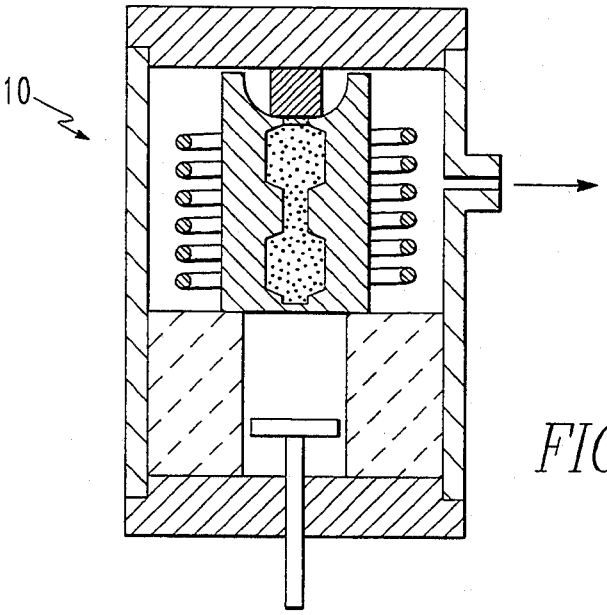
Figure 1C:
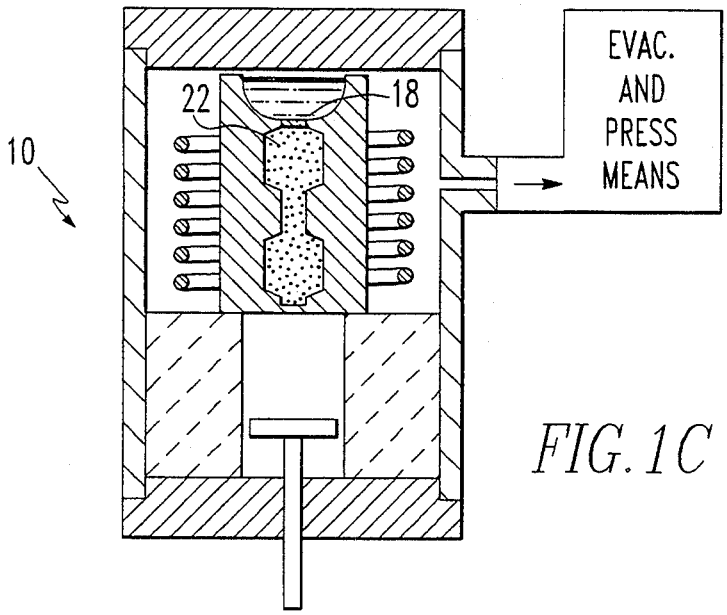
Figure 1D:
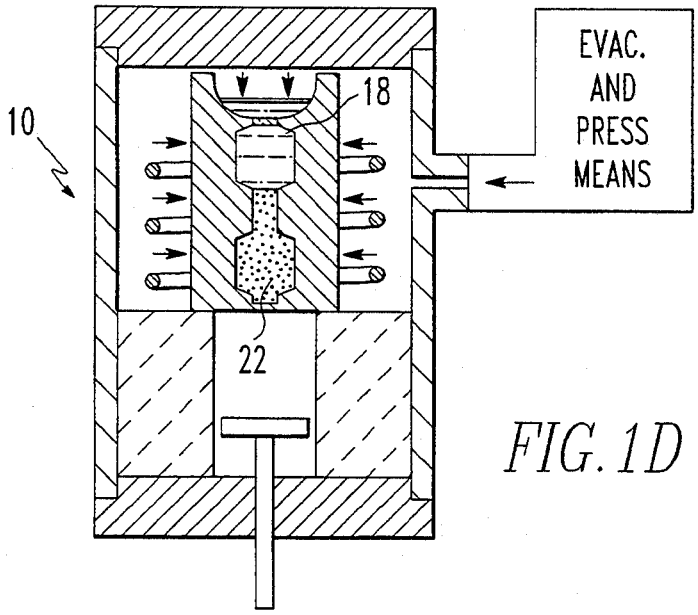
Figure 1E:
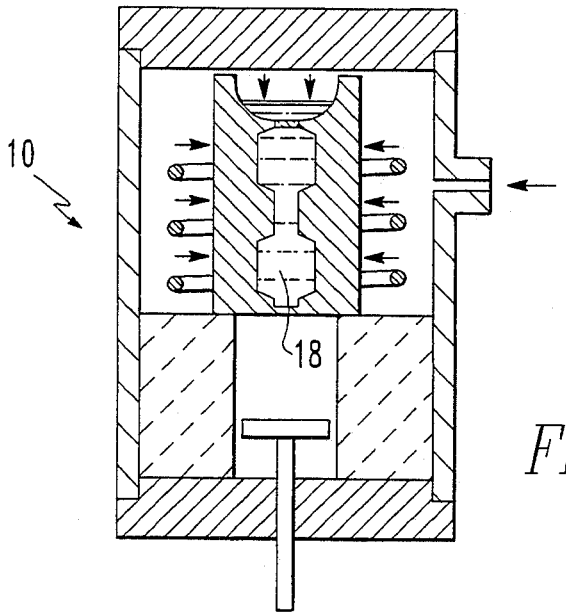
Figure 1F:
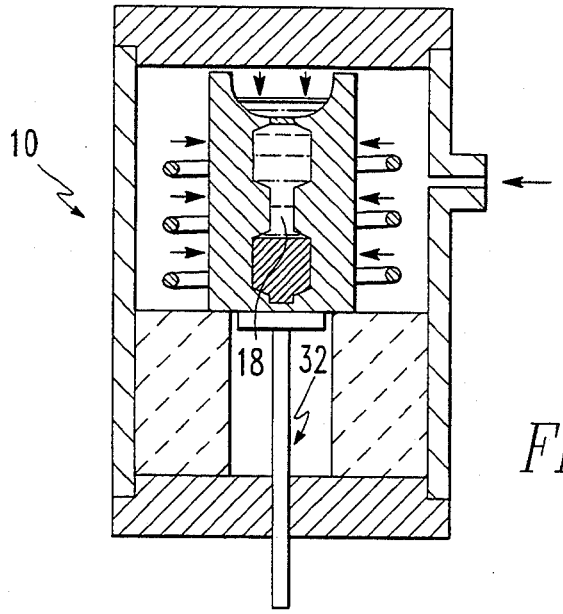

Preferably, the solidifying means includes a chill plate 30 connected to a chill plate lifter 32 for lifting the chill plate 30 such that it is placed in thermal contact with the bottom of mold 20, as shown in FIG. 1F. FIG. 1F is a cross-sectional schematic view of an apparatus 10 with the mold 20 in thermal contact with the chill plate 30 after chill plate lifter 32 has lifted the chill plate 30. (Note: FIGS. 1A–1F are drawn to scale so that the relationship of the various elements and structures thereof are defined regardless of the actual size chosen therefore.)

Figure 3A:
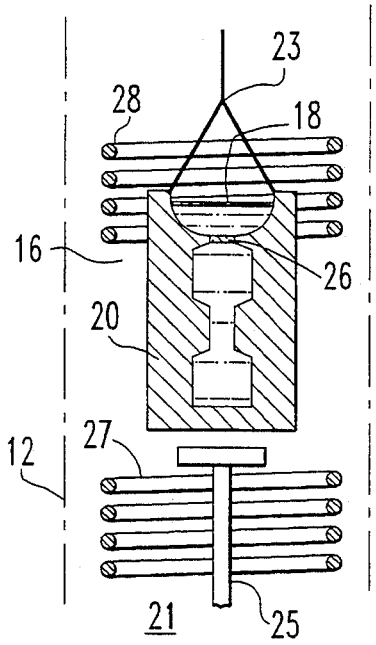
FIGS. 3A and 3B are cross-sectional schematic views of a mold being moved into a cold chamber of a pressure vessel.
Figure 3B:
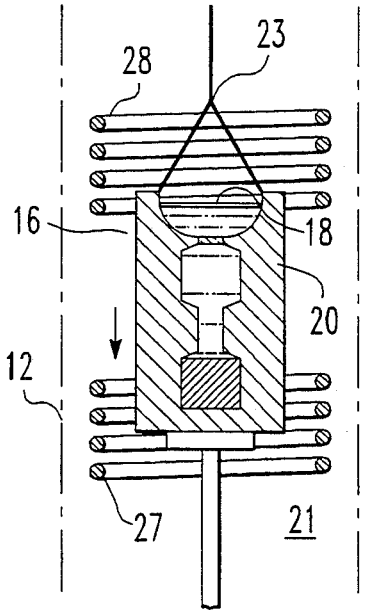

Alternatively, the directionally solidifying means can include means for moving the mold 20 with the melted material 18 into a cold chamber 21 in the vessel 12. The moving means can include, for instance, a rod or cable 23 attached to the top of the chamber 16, a piston 25 disposed below the mold 20, or both, to move the mold 20 into the cold chamber 21. The cold chamber 21 can, for instance, be tubes 27 of water flowing around a lower portion of the vessel 12 to provide the cooling, as shown in FIGS. 3A and 3B.

Figure 4:
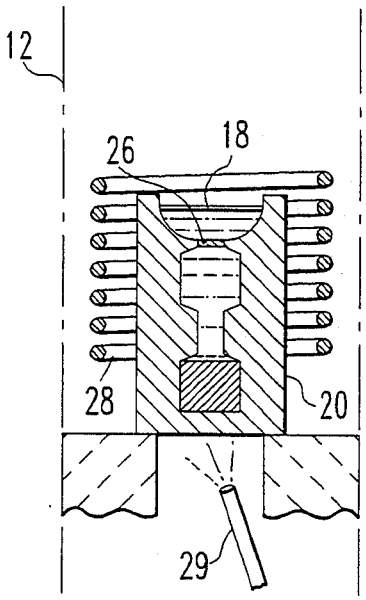
FIG. 4 is a cross-sectional schematic view of a gas chill.

The solidifying means alternatively can include an inlet 29 disposed through the vessel 12 and aligned with the mold 20 through which cool gas is introduced into the vessel 12 such that the gas strikes the mold 20 and directionally solidifies the material 18 in the mold 20, as shown in FIG. 4.

Figure 5:
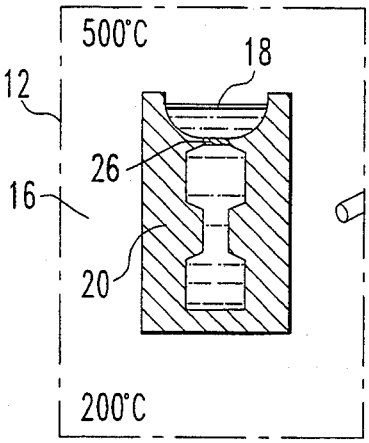
FIG. 5 is a cross-sectional schematic view of a thermal gas gradient.
Figure 6:
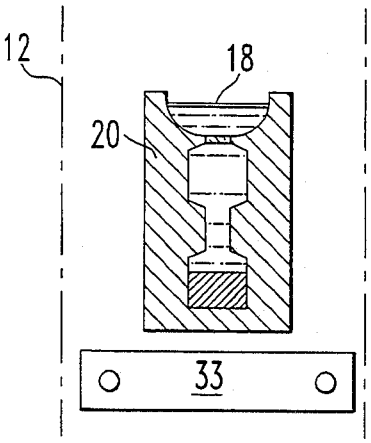
FIG. 6 is a cross-sectional schematic view of a cold transfer mechanism.

The solidifying means may instead include means for producing a thermal gas gradient in the vessel 12, as shown in FIG. 5. The gas thermal gradient is formed, for instance, by first evacuating the vessel 12 having melted material 18 in the chamber 16. The pressure in the vessel 12 is then increased with the introduction of gas. The gas forces the melted material 18 through the filter 26 to the mold 20. The melted material 18 forms around the preform 22 disposed in the mold 20. The gas that first enters the vessel 12 to pressurize it is heated by the melted material 18. As further gas is introduced into the vessel 12, it is at a cooler temperature than the gas that has already been heated by the melted material 18. As the pressure is increased due to more gas entering the vessel 12, the melted material 18 is forced into and infiltrates the preform 22. The heated gas already in the vessel 12 rises as the cooler gas is introduced into the vessel 12 to continue to raise the pressure therein. Through this procedure, for instance, a pressure of 1000 PSI in the vessel 12 creates a gradient of about 600° between the top and bottom of the vessel 12 which is approximately 12 inches in length. As shown in FIG. 5, a temperature of 200° C. at the bottom of the vessel and a temperature of 500° C. at the top of the vessel causes directional solidification in the material 18. The cooler gas which collects at the bottom of the vessel causes a directional solidification to occur in the material 18.

In another alternative embodiment, the solidification means can include a cooled body 33 disposed in the vessel 12 which is in spaced relationship with the mold 20 such that as pressure increases in the vessel 12, heat transfer increases between the body 33 and the mold 20, directionally solidifying the material 18. The gas which provides the pressure, serves to act as a thermal conductor between the body 33 which, for instance, can be cooled with water and may be the bottom of the vessel 12 and the part of the mold 20 which is closest to it, thus cooling it and setting up the directional solidification. As the pressure increases and the gas therein becomes denser, the heat transfer properties of the gas increase, thus better serving to cool the mold 20.

Figure 2A:
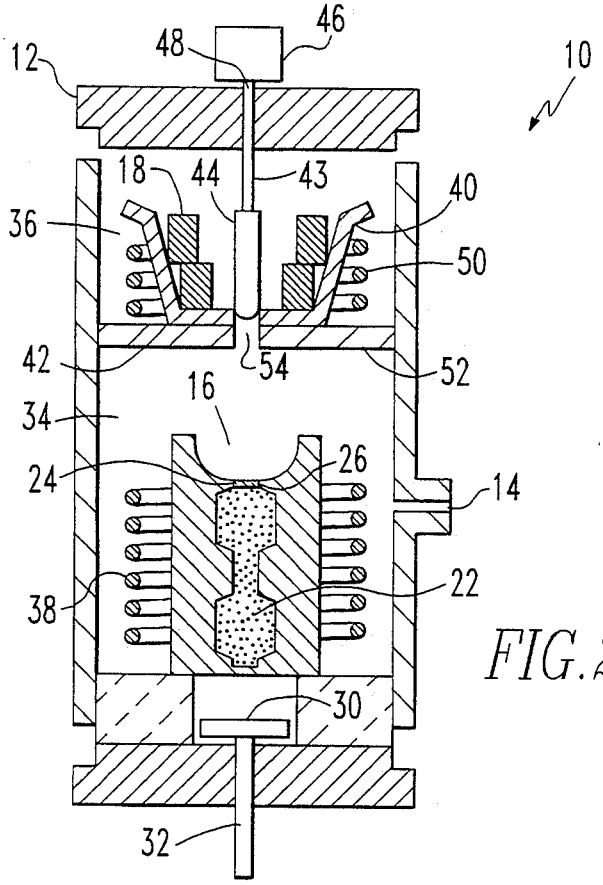

In an alternative embodiment and referring to FIG. 2A, the vessel 12 comprises a mold section 34 and a melt section 36. The mold 20 within which the preform 22 is held is disposed beneath the chamber 16 in the mold section 34. The mold section is in the lowermost portion of vessel 12 and comprises its own heating means, preferably a mold furnace 38, such that the mold furnace 38 allows the material to remain melted as it enters the mold 20 and the preform 22. It should be noted, however, that the mold furnace 38 is not necessary for the effective operation of the apparatus 10.

Figure 2B:
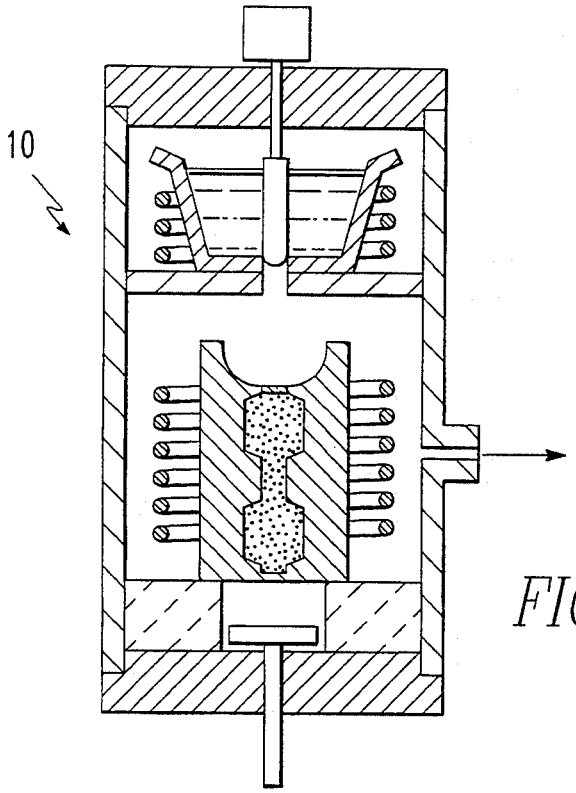
Figure 2C:
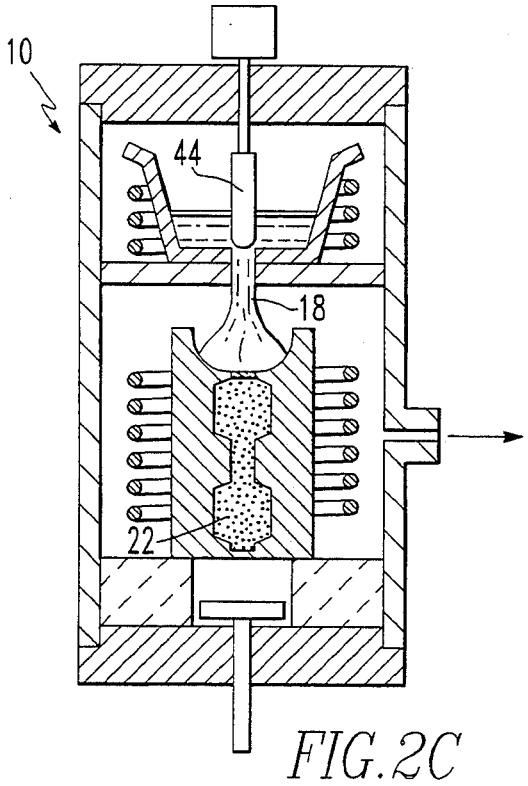

The melt section comprises a crucible 40 within which material 18 is stored and melted. The crucible 40 has a hole 42 disposed through its bottom surface. A plug 44 of plug lift system 46 fluidically seals and opens the hole 42, as the plug lifter 48 of plug lift system 46 raises and lowers the plug 44. The plug 44 is preferably made of ceramic. The melt section further comprises heating means such that the material 18 in crucible 40 is melted and stays melted as it flows through hole 42 as plug lifter 48 is raised. For instance, with aluminum, the temperature should be over 600° C. and preferably between 650° C. and 700° C. The heating means preferably includes melt furnace 50 positioned about the crucible 40 to provide essentially uniform heating to the material 18. The mold section 34 and melt section are separated by an insulative barrier 52 having an insulation hole 54 disposed below the hole 42 of crucible 40 such that the melted material in crucible 40 can flow through hole 42 and insulation hole 54, as the plug lifter 48 raises the plug 44 away from hole 42 as shown in FIG. 2C. The insulative material 52 maintains a heat differential between the melt section and the mold section. Directionally solidifying means can also be present, as described above to directionally solidify the melted material.

The present invention also pertains to a method for producing a fiber reinforced material. The method comprises the steps of loading a mold 20 containing a preform 22 and having a passage 24 within the pressure vessel 12. A filter 26 is disposed within the passage 24. Then, the step of placing in the chamber 16 of the pressure vessel 12 the material 18, as shown in FIG. 1A is performed. Next, the step of evacuating the pressure vessel 12 through the port 14 as shown FIG. 1B is performed. Then, the step of melting the material 18 in the chamber 16, as shown in FIG. 1C, is performed. Next, the step of pressurizing the vessel 12 such that the melted material 18 is forced down into the mold 20 and forced into the preform 22, as shown in FIG. 1D, is performed. The pressurizing step preferably includes the step of controlling the rate at which pressurization of the vessel 12 occurs such that the pressure in the mold 20 is able to have time to be driven toward instantaneous equilibrium with the pressure in the vessel 12. Then, the step of directionally solidifying the material, for instance, by raising the chill plate lifter 32 allowing the chill plate 30 to thermally contact the bottom of mold 20, as shown in FIG. 1F, is performed, thereby initiating directional solidification. Then, pressure is released and the mold 20 is removed from the pressure vessel 12.

Figure 2D:
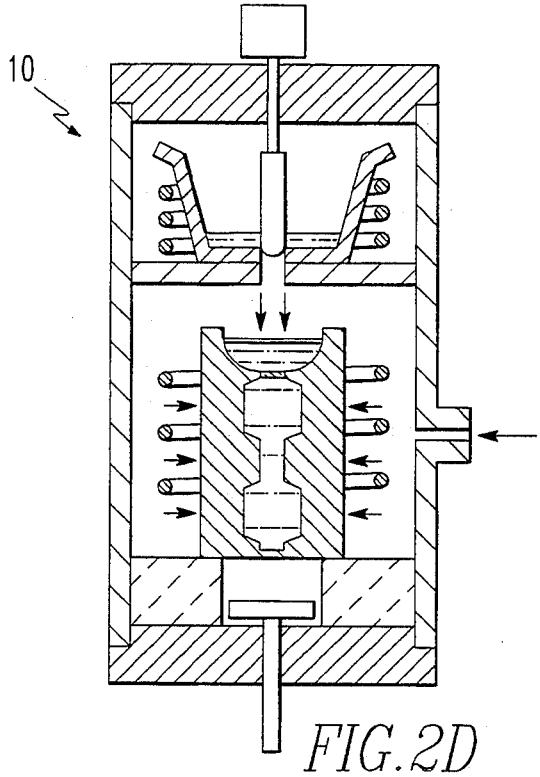
Figure 2E:
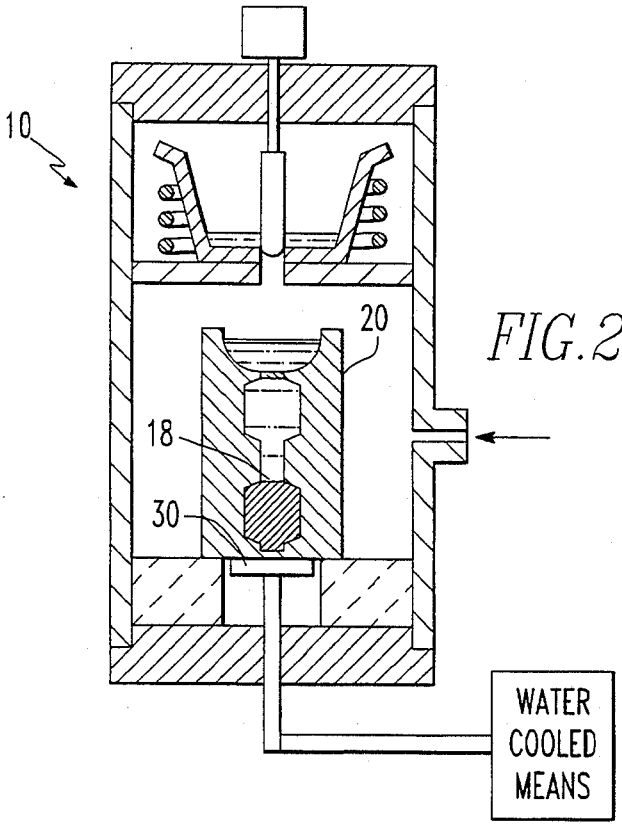

The present invention also pertains to a method for using the pressure vessel 12 having separate sections, a melt section 36 and a mold section 34 to produce a fiber reinforced material. The method comprises the steps of loading the pressure vessel 12 by disposing the mold 20, containing a preform 22 and a filter 26 in the mold section 34 of the pressure vessel 12 and placing the crucible 40 containing material 18 within the melt section of the pressure vessel 12 such that the plug 44 of plug lift system 46 seals the hole 42 of crucible 40, as shown in FIG. 2A. Next, the step of evacuating the pressure vessel 12 through port 14 as shown in FIG. 2B is performed. Then, the step of melting the material 18 in crucible 40, as also shown in FIG. 2B is performed. Then, the step of lifting the plug 44 with plug lifter 48 is performed thereby allowing the melted material 18 to flow through hole 42 and insulation hole 54 and into the chamber 16. Then, the step of pressurizing the vessel 12 such that the melted material 18 is forced down into the mold 20 and forced into the preform 22, as shown in FIG. 2D, is performed. The pressurizing step preferably includes the step of controlling the rate at which pressurization of the vessel 12 occurs such that the pressure in the mold 20 is able to have time to be driven toward instantaneous equilibrium with the pressure in the vessel 12. Then, the directionally solidifying step of, for instance, raising the chill plate lifter 32 allowing the chill plate 30 to thermally contact the bottom of mold 20 thereby initiating directional solidification, as shown in FIG. 2E is performed. Then, pressure is released and the mold 20 is removed from the pressure vessel 12.

In the operation of the preferred embodiment, the chamber 16 is loaded with aluminum and placed in the vessel 12 which is then sealed, preferably with high temperature VITON® seals. The vessel is then evacuated through port 14, as shown in FIG. 1B thereby removing any gas from the vessel 12. The mold furnace 28 is then activated to melt the aluminum in chamber 16, as shown in FIG. 1C, while the vessel is continuously evacuated. By evacuating the vessel 12 and mold 20, there is less chance of voids being formed in the fiber reinforced material after the melted material has infiltrated the preform 22.

As the aluminum in the chamber 16 is melted, the melted aluminum covers the passage 24 thereby fluidically isolating the interior of the mold 20 from direct communication with the vessel interior such that the melted aluminum in the chamber 16 can be forced down into the mold 20 and preform 22 through the passage 24 under the action of the pressurization means, as shown in FIG. 1D.

Once the melted aluminum has been melted, the pressurization means introduces pressurized nitrogen gas into the vessel 12, as shown in FIG. 1D. The pressure in the vessel 12 is consequently increased throughout the vessel 12 and specifically at the surface of the melted aluminum in the chamber 16. As the melted aluminum in the chamber 16 prevents the pressurized gas in the vessel 12 from passage 24 and reaching the interior of mold 20 since the interior of the mold 20 is fluidically isolated from direct communication with the interior of the pressure vessel, a pressure differential is created between the interior of the vessel 12 and the interior of the mold chamber 16. This pressure differential results in the melted aluminum being forced down through the passage 24 and through the porous ceramic filter 26, and into the mold chamber 20, as shown in FIG. 1D. The amount of melted aluminum that is forced into the mold 20 and consequently the preform 22 corresponds to the amount of pressure in the vessel 12 at the surface of the melted aluminum in the crucible 14. The more pressure in the vessel, the more fluid is forced into the mold 20 and preform 22 to compensate for the difference in the pressure between the inside of the mold 20 and the inside of the vessel 12. As the aluminum is forced into the preform 22, the pressure is equalized between the inside of the mold 20 and the inside of the vessel 12 itself. By controlling the pressurization rate, it is possible to control the difference between the pressure on the inside and outside of the mold 20. The slower the rate, the lower the pressure exerted on the outside of the mold 20 and so a thinner or lower strength wall thereof is required. Quick pressurization rates require heavy walls to withstand the pressures exerted on the walls of the mold 20.

After the melted aluminum fills the preform 22, the lifter 32, which can be in the form of a pneumatic piston passing through the vessel and sealed with an o-ring, lifts the chill plate 30 into thermal contact with the bottom of mold 20. This causes the melted aluminum in mold 20 nearest the water cooled chill plate 30 to solidify. This solidification of the melted aluminum propagates as a wave from the bottom of mold 20. The pressurization means remains active during this directional solidification allowing extra melted aluminum to fill the mold 20 as the aluminum in the mold 20 cools and thus shrinks.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for casting comprising:

a pressure vessel;

means for pressurizing the vessel, said pressurizing means fluidically connected to the vessel;

a chamber disposed in the pressure vessel within which material is melted;

a mold adapted to contain a preform disposed in the pressure vessel and in fluidic connection with the chamber by a passage such that melted material in the chamber can be forced down into the mold through the passage as the pressurizing means pressurizes the vessel, said passage contains a filter such that the melted material is prevented from entering the interior of the mold prior to pressurization but passes through the filter upon a desired pressurization;

means for heating material in the chamber and the mold such that material is melted in the chamber and stays melted as it is forced down into the mold while the pressurizing means pressurizes the vessel, said heating means disposed in the vessel; and means for directionally solidifying the material in the mold.

2. An apparatus as described in claim 1 wherein the heating means includes a furnace for heating the mold and material within the chamber.

3. An apparatus as described in claim 1 wherein the solidifying means includes a cold chamber in said pressure vessel and means for moving the mold into the cold chamber.

4. An apparatus as described in claim 1 wherein the solidifying means includes a cooled body disposed in said vessel in spaced relationship with said mold such that as pressure increases in the vessel, heat transfer increases between the body and the mold, directionally solidifying the material.

5. An apparatus as described in claim 1 including means for evacuating the vessel, said evacuating means fluidically connected to the pressure vessel.

6. A method for casting comprising the steps of:

loading a pressure vessel by disposed a material within a chamber whereby the material is in fluidic connection with a mold adapted to contain a preform through a passage, said passage having a filter disposed therein;

melting the material in the chamber with heating means disposed in the chamber whereby the melted material fluidically seals the passage thereby isolating the interior of the mold from the interior of the vessel, said filter prevents melted material from entering the interior of the mold;

pressurizing the vessel such that the melted material is forced past said filter and down into the interior of the mold; and directionally solidifying the material in the mold.

7. An apparatus for casting comprising:

a pressure vessel;

means for pressurizing the vessel, said pressurizing means fluidically connected to the vessel;

a chamber disposed in the pressure vessel within which material is melted;

a mold adapted to contain a preform and disposed in the pressure vessel and in fluidic connection with the chamber by a passage such that melted material in the chamber can be forced down into the mold through the passage as the pressurizing means pressurizes the vessel, said passage contains a filter such that the melted material is prevented from entering the interior of the mold prior to pressurization but passes through the filter upon a desired pressurization;

means for heating the material in the chamber and the mold such that material is melted in the chamber and stays melted as it is forced down into the mold while the pressurizing means pressurizes the vessel, said heating means disposed in the vessel; and means for directionally solidifying the material in the mold, said solidifying means including an inlet fluidically connected to a gas source and disposed through said vessel and aligned with said mold through which cool gas is introduced into the vessel such that the gas strikes the mold and directionally solidifies the material in the mold.

8. An apparatus for casting comprising:

a pressure vessel;

means for pressurizing the vessel, said pressurizing means fluidically connected to the vessel;

a chamber disposed in the pressure vessel within which material is melted;

a mold adapted to contain a preform and disposed in the pressure vessel and in fluidic connection with the chamber by a passage such that melted material in the chamber can be forced into the mold through the passage as the pressurizing means pressurizes the vessel, said passage contains a filter such that the melted material is prevented from entering the interior of the mold prior to pressurization but passes through the filter upon a desired pressurization;

means for heating material in the chamber and the mold such that material is melted in the chamber and stays melted as it is forced down into the mold while the pressurizing means pressurizes the vessel, said heating means disposed in the vessel; and means for directionally solidifying the material in the mold, said solidifying means includes means for producing a gas thermal gradient.

9. An apparatus for casting comprising:

a pressure vessel comprising a melt section and a mold section separated by a surface, said melt section disposed in the upper portion of the pressure vessel, said melt section comprising a crucible within which material is stored and melted, a first hole disposed on the crucible's bottom surface and a second hole disposed under said first hole in the surface, and a plug lift system comprising a plug and a plug lifter whereby the plug lifter raises and lowers the plug into and out of the first hole such that when the plug is lowered into the first hole, the melted material cannot flow out of the crucible, said mold section is disposed in the lower portion of said pressure vessel, said mold section comprising a chamber for holding said melted material;

means for pressurizing the vessel, said pressurizing means in fluidic connection with the vessel;

a mold having a passage fluidically connecting said chamber to the interior of said mold, said passage includes a filter such that the melted material is prevented from entering the interior of the mold prior to pressurization;

means for heating material in the crucible such that material is melted in the crucible and stays melted as it flows downward into the chamber of the mold section as the plug lifter lifts the plug away from the hole of the crucible; and means for directionally solidifying the material.

10. An apparatus as described in claim 9 including means for heating the mold within said mold section such that the melted material does not solidify as it enters the mold.

* * * * *

UNITED STATES PATENT AND TRADEMARK OFFICE

CERTIFICATE OF CORRECTION

PATENT NO. : 5,348,071

DATED : September 20, 1994

INVENTOR(S) : Arnold J. Cook

It is certified that error appears in the above—identified patent and that said Letters Patent is hereby corrected as shown below:

Column 2, line 56, change "2G" to -- 2E -- .

Signed and Sealed this

Twentieth Day of June, 1995

Bruce Lehman

*Attest:*

BRUCE LEHMAN

*Attesting Officer*

*Commissioner of Patents and Trademarks*